US005386701A

United States Patent [19]

Cao

[11] Patent Number: 5,386,701

[45] Date of Patent: Feb. 7, 1995

[54] HUMAN BODY COOLING SUIT WITH HEAT PIPE TRANSFER

[76] Inventor: Yiding Cao, 10900 SW. 104th St. #118, Miami, Fla. 33176

[21] Appl. No.: 191,215

[22] Filed: Feb. 3, 1994

[51] Int. Cl.[6] ..... F25D 23/12

[52] U.S. Cl. ..... 62/259.3; 165/104.17

[58] Field of Search ..... 62/259.3, 4, 480, 261; 165/104.17, 104.11; 126/204, 205

[56] References Cited

U.S. PATENT DOCUMENTS 5,201,365 4/1993 Siegel ..... 62/259.3

*Primary Examiner*—John M. Sollecito

[57] ABSTRACT

Described herein is a new human body cooling suit that is comprised of a number of flexible heat pipes and a (or a number of) phase-change material (PCM) module (or modules). A lower section (with reference to the gravity field) of the flexible heat pipe is sandwiched between the outer cover and the inner lining materials. An upper section of the heat pipe runs through the PCM module. The shell of the said flexible heat pipe can be a corrugated metal tube, a corrugated plastic tube, or a smooth plastic tube, depending on specific applications. The said outer cover is made of thermal insulating materials that shield off the heat from the environment to the human body. When a human being, who wears this cooling suit, is exposed to a very hot environment, the flexible heat pipe section embedded in the suit materials absorbs the heat that is dissipated from the human body, and transfers it to the said PCM module where the heat is stored in the PCM module via the change of phase. Since the PCM is chosen such that it has a melting temperature close to the normal temperature range of the human body and a large latent heat of melting, and the heat pipe has an extremely high effective thermal conductance, the human body temperature can be maintained at a temperature close to normal, regardless of the environment a person encounters. Three types of PCM modules, in which the thawed PCM can be easily replaced, are also described.

3 Claims, 4 Drawing Sheets

HUMAN BODY COOLING SUIT WITH HEAT PIPE TRANSFER

FIELD OF THE INVENTION

This invention relates to heat engineering, and more particularly, to heat transfer and storage devices.

The invention can find application in the protection of human beings from extremely hot environments, including fire fighters, steel makers, molders and forgers, desert oil field workers, and other workers whose jobs require them to be exposed to hot surroundings.

BACKGROUND OF THE INVENTION

Protection of human beings from extremely hot environments is of significant practical importance. Oil field workers in a broiling summer desert, steel makers in front of furnaces, molders and forgers handling fiery work pieces, and fire fighters in a burning house all need protection from extremely hot environments. However, no efficient cooling method is available at the present time. Forced convective cooling has been proposed to cool the human body for persons working in an extremely hot environment, such as on-duty fire fighters. However, in this case, a cable is needed to connect the human body and the heat sink. This is impractical when the distance between the working position and the heat sink is relatively long. The cable is too heavy for a person to carry and may be tangled during operation, which could cause the coolant flow to cease in the cable. Also, the cable may restrain a worker's free movements that are needed for a fire fighter in a burning house or a petroleum drilling worker on a drilling platform.

Heat pipes combined with phase-change material (PCM) energy storage systems are a solution for human body temperature control. Heat pipes are heat transfer devices with a very high heat conductance. They can transfer a large quantity of heat from one place to another with a very small temperature drop. PCM energy storage systems absorb or release heat energy via melting at a nearly constant phase-change temperature. The incorporation of heat pipe/PCM energy storage systems in a human body temperature-control suit can effectively cool the human body at a fairly uniform and human-tolerable temperature.

The heat pipe is a device with an effective thermal conductance hundreds of times higher than that of copper. A tube or other type of container with a porous wick structure placed on the interior surface is filled with a small amount of working fluid. Air is evacuated from the container and the container is sealed. Heat is applied to the evaporator section, which causes the liquid to vaporize. The vapor then moves from the hotter section due to the higher vapor pressure to the colder section of the heat pipe, where it is condensed. The liquid condensate then returns to the heated section in the wick structure due to a capillary pumping action. Since the latent heat of vaporization is very large, high heat transfer rates can be achieved with a small temperature difference between the hot and cold sections, and consequently, the temperature is rather uniform along the heat pipe length. Gravity may be used to assist the liquid return and increase the heat transport capacity of the heat pipe. In this case, a capillary structure on the interior surface of the heat pipe may not be necessary. For more detailed descriptions on heat pipes, it is sufficient to cite a publication entitled, "Heat Pipe," by P. D. Dunn and D. A. Ready, Pergamon Press, Oxford, N.Y., 1982, where such a general description of heat pipes is contained in pages 1 to 20.

The heat pipe to be used in the human body cooling suit should be flexible without seriously restraining movement. The flexible heat pipe was first proposed to be used on human beings for hand protection from extreme cold by Faghri et al. in the paper entitled, "Heat Pipes for Hands," Mechanical Engineering, June, 1989, pages 70 to 74. They found that the human elbow has enough heat to keep the fingers warm in cold weather, and that the heat pipe proved to be an efficient means to deliver that energy.

SUMMARY OF THE INVENTION

The object of this invention is to incorporate flexible heat pipe and phase-change energy storage technology into suits to protect human beings from extremely hot environments.

Flexible heat pipes are sandwiched between the outer cover and the inner lining material, and extend from the bottom of the suit to the shoulder, where they converge and run through the PCM energy storage module. In the PCM module, phase-change material is packed inbetween these heat pipes. The phase-change material can be chosen such that it has high latent heat of melting and its phase-change temperature is close to the human body tolerable temperature. Initially, the phase-change material is in a solid state. When the human body is subjected to an extremely hot environment, the outer cover, which is made of thermal insulating materials, shields off the heat from the environment, and the heat pipe section sandwiched in the suit materials absorbs the heat that is dissipated from the human body and transfers the heat to the PCM module where it is rejected to the phase-change material packed inbetween these heat pipes. The phase-change material absorbs the heat from the heat pipes via melting. Since the phase-change material has a fairly constant melting temperature, the temperature of the PCM module can be maintained at a relatively constant temperature during the phase-change process. And since the heat pipes have an extremely high effective thermal conductance, the temperature drop between the bottom of the suit and the PCM module should be small. Therefore, the whole suit can be maintained at a fairly uniform temperature close to (slightly higher than) the melting temperature, $T_m$, of the phase-change material. Because the phase-change material is so chosen that its melting temperature is close to the human body tolerable temperature, the human body temperature can be maintained at temperatures close to normal, regardless of the environment a person encounters.

The major advantages of the cooling suit invented here over other potential cooling methods are that the whole system operates passively without requiring any moving machines; no connecting cables are needed, thus the person wearing the suit can move freely; and the cost of operation is very low compared to other cooling methods due to its passive and simple structure.

Since the phase-change material has a large latent heat of melting, a large amount of heat can be absorbed and stored in the PCM module with a relatively small amount of phase-change material. More importantly, only the heat dissipated from the human body, which is rather small, needs to be stored in the PCM module due to the insulating function of the outer cover. Therewith, the amount of PCM needed is reasonably small without causing any difficulty for a person who carries the module. On the other hand, for a given amount of phase-change material, the operation period can be fairly long before completion of the change of phase for the whole PCM module. Moreover, the PCM module is so designed that the completely thawed module can be removed from the flexible heat pipes, and a new module can be easily installed when the operation time is lengthy. The thawed module can be placed in a chiller for re-freezing and can be reused. This is especially important for some applications, such as oil field workers in the hot desert whose jobs require them to work outdoors for a long period of time.

In theory, the PCM module may be carried anywhere on the body. However, for the cooling application, it is advantageous to carry the module over the shoulder. Since the heat pipe section sandwiched in the suit functions as an evaporator, and the section running through the PCM module functions as a condenser, gravity will assist the return of the working fluid in the flexible heat pipes, and as a result, the wick structure in the heat pipe may not be necessary, and the design and manufacture of the flexible heat pipes will be much easier. Instead of being carried on the body, the PCM module may also be placed at a location higher than the lower section of the heat pipe when the person who wears the cooling suit may have to stay in the same place for an extended period of time.

DETAILED DESCRIPTION OF THE INVENTION

Figure 2:
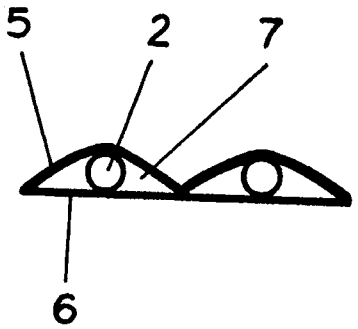
FIG. 2 is a schematic representation of the cross section of the cooling suit in FIG. 1 taken along B—B.
Figure 1:
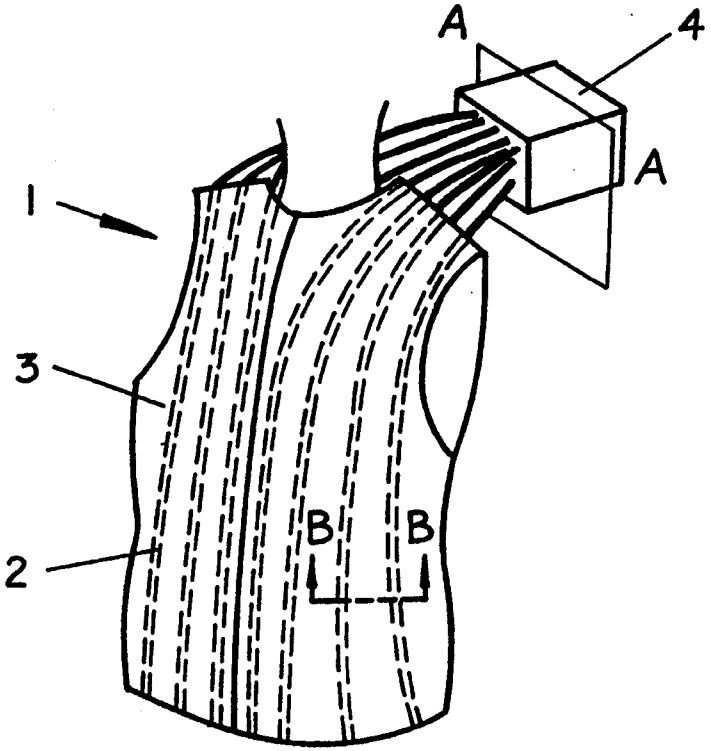
FIG. 1 is a schematic representation of the human body cooling suit.

FIG. 1 schematically depicts a human body cooling suit using the flexible gravity-assisted heat pipe/PCM energy storage system. Flexible heat pipes 2 sandwiched in the suit materials 3 extend from the bottom of the suit 1 to the shoulder where they converge and run through the PCM energy storage module 4. The PCM module 4 may be carried over the shoulder or attached to the suit. The outer cover 5 (FIG. 2), which shields off the heat from the environment, is made of thermal insulating materials. When the thermal radiation is significant from the environment to the human body, a coating material with high radiation reflectivity may be used on the outer surface of the cover. The inner lining material 6 may be ordinary materials used in the normal daily life. The air enclosed in the space 7 circulates due to free convection, which helps to make the temperature in the space 7 uniform. It should be pointed out that in FIG. 1, the flexible heat pipes are seen running only through the torso part of the suit due to the schematic nature of the figure. However, the system can also be designed so that the flexible heat pipes are embedded in other parts of the suit. Also, the heat pipe arrangement in the suit and the PCM module positions can be different for different applications and for cooling different parts of the human body.

Figure 3:
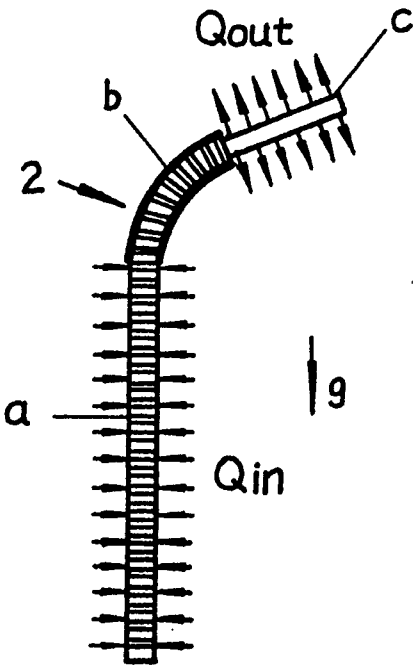
FIG. 3 is a schematic representation of a flexible heat pipe used in the human body cooling suit.

The flexible heat pipe generally consists of three sections (FIG. 3). The evaporator section, a, which is embedded in the suit, absorbs heat, $Q_{in}$, from the body and transfers it to the condenser section, c. The condenser section, c, which runs through the PCM module 4 in FIG. 1, rejects heat, $Q_{out}$, to the phase-change material (PCM) packed in the PCM module. The transition section, b, between the evaporator section, a, and the condenser section, c, is called the adiabatic section that should be insulated to avoid the addition of heat to the heat pipe in this section. The evaporator section, a, and the transition section, b, should be sufficiently flexible so that the cooling suit is soft enough for a person to wear, while at the same time providing enough strength to maintain a certain vapor passage inside the pipe without interrupting the necessary working fluid flow. The condenser section, c, however, should be relatively rigid so that it can be inserted into or pulled out of the PCM module 4 in FIG. 1. The diameters of the flexible heat pipes are on the order of a few millimeters. However, the optimum diameter varies with specific application and heat input, $Q_{in}$, in the evaporator section, a. A corrugated stainless steel shell can be used for the flexible sections, which include the evaporator section, a, and the transition section, b. For some applications, a corrugated or smooth plastic tube, which is sealed on both ends, can be used as the shell of the flexible heat pipe, so that the cooling suit is much softer and less costly. Since the flexible heat pipe is placed in a gravity field, g, which is shown in FIG. 3, the liquid condensate inside the heat pipe at the condenser section, c, can be returned to the evaporator section, a, under the assistance of gravity. Therefore, no wick structure on the interior surface of the heat pipe is needed, and a tube with a smooth-walled interior can be used for the flexible heat pipe. As a result, either a metal or a plastic flexible heat pipe can be manufactured cost effectively, and, unlike the flexible heat pipes having wick structures, without any technological difficulties. The working fluid inside the flexible heat pipe should have a normal working temperature close in range to the human body temperature. The corresponding vapor pressure should be low for structural and safety considerations so that no special structural requirement for the shell of the heat pipe is necessary to accommodate the vapor pressure inside the heat pipe.

Figure 4:
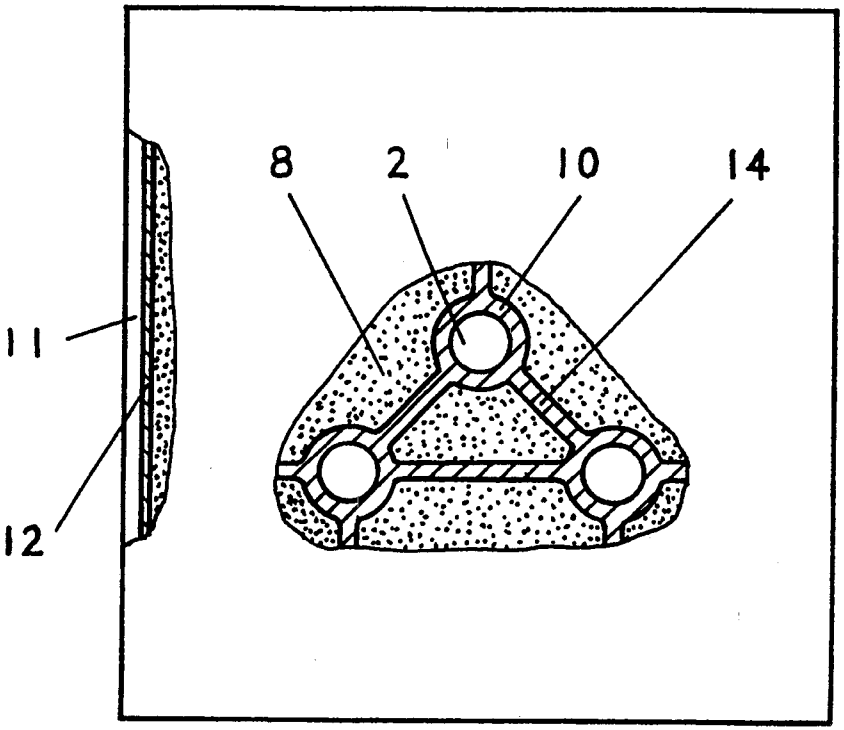
FIG. 4 is a partially cut-away schematic view of the PCM module in FIG. 1 taken along the plane, A—A, for PCM module design I.

FIG. 4 shows schematically the partially cut-away view of the PCM module in FIG. 1 taken along the plane, A—A, for PCM module design I. The heat pipes 2 are inserted into the sleeves 10, which are interconnected and integrated with the PCM module container 12 through thin connecting ribs 14. An amount of PCM 8 is packed inbetween the sleeves 10, ribs 14, and container 12. To reduce the heat absorption of the container 12 from the surroundings, a removable insulation cover 11 is placed outside the container 12. The exterior surfaces of the heat pipes 2 inserted into the sleeves 10 are in good thermal contact with the interior surfaces of the sleeves 10. However, the heat pipes 2 can also be pulled out of the sleeves 10, and be inserted into the sleeves of a new PCM module. In case a worker is required to be exposed to hot surroundings for a long period of time, and after the PCM 8 packed in the container 12 has completely thawed, the heat pipes 2 can be pulled out of the sleeves 10, and the thawed PCM module can be replaced with a new module with frozen PCM inside. The thawed module can then be placed into a chiller for re-freezing after removing the insulation cover 11, and can be reused after the PCM 8 is completely frozen. The ribs also enhance the heat transfer between the heat pipes 2 and the PCM 8. Any materials that have a melting temperature slightly lower than the normal human body temperature, a high latent heat of melting, relatively low density, and are nontoxic, are suitable for use as the PCM 8 in the PCM module. One of the most convenient and accessible PCMs is ice. Although the melting temperature of ice is a little bit too low compared to the normal human body temperature, it has a large latent heat of melting, and is the cheapest material available. The cooling suit temperature can be adjusted by placing a layer having a low thermal conductivity between the sleeve 10 and the heat pipe 2 in case the melting temperature of the PCM 8 is too low. The cooling suit temperature can also be adjusted by changing the location of the PCM module relative to the lower section of the flexible heat pipe.

Figure 5:
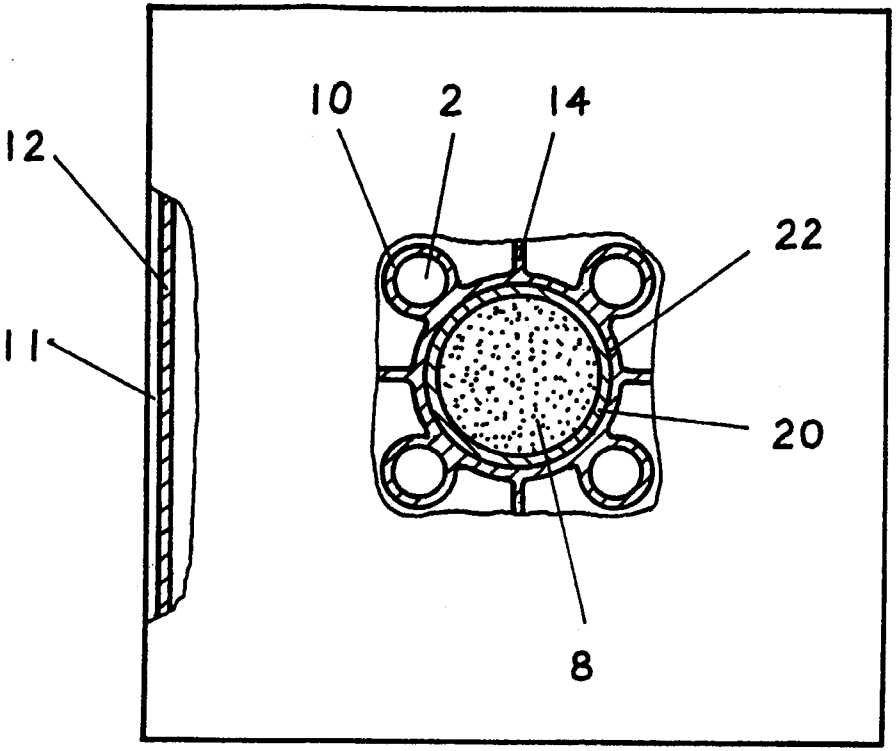
FIG. 5 is a partially cut-away schematic view of the PCM module in FIG. 1 taken along the plane, A—A, for PCM module design II.

In the case where the PCM module needs to be replaced frequently, the PCM module design II shown in FIG. 5 can be used. A canister 20 is filled with the PCM 8, and the canister 20 is inserted into a large sleeve 22 which is in good thermal contact with the exterior surface of the canister 20. The large sleeves 22 are supported and integrated with the PCM module container 12 through connecting ribs 14. A number of small sleeves 10 are attached on the outer circumferential surface of the large sleeve. Each small sleeve 10 houses a heat pipe 2 with tight contact. A number of such units, which consist of a large sleeve 22, a PCM canister 20, and a number of small sleeves 10, which house heat pipes 2, can be placed in the PCM module container 12. When the PCM 8 in the canister 20 is completely thawed, the canisters 20 can be pulled out of the large sleeve 22, and a new canister with frozen PCM can be inserted into the large sleeve 22. The thawed PCM canister can then be placed into a chiller for freezing and reused later. By doing so, the heat pipes 2 do not need to be pulled out of the small sleeves 10, the whole PCM module does not need to be removed or replaced, and only the PCM canisters 20 need to be replaced each time.

Figure 6:
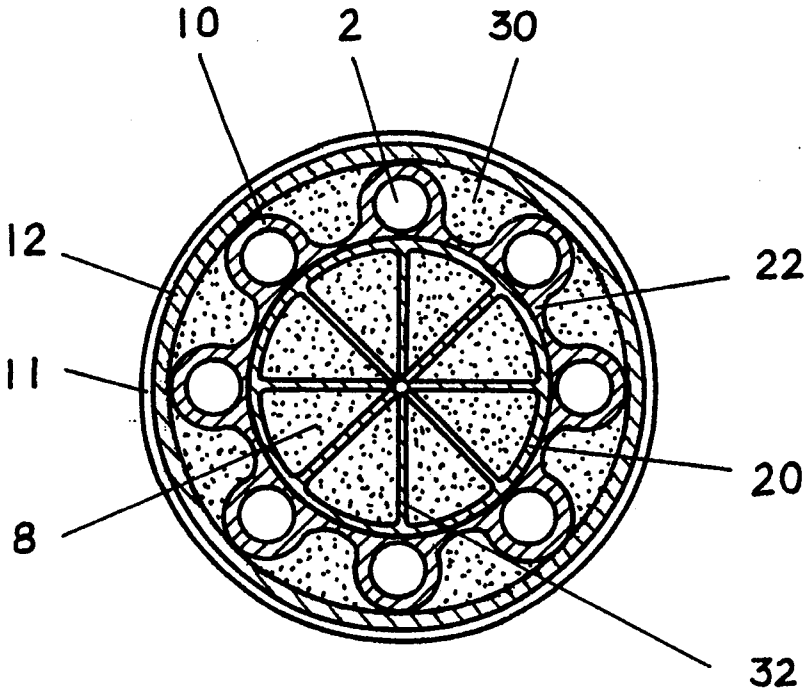
FIG. 6 is a cut-away schematic view of the PCM unit.

The said unit can also be housed in a smaller cylindrical container 12 (FIG. 6) with a removable insulation cover 11. Inbetween the large sleeve 22 which houses the PCM canister 20 filled with PCM 8, a number of small sleeves 10 each of which houses a heat pipe 2, and the interior surface of the container 12, a heat transfer medium 30 can be filled to enhance the heat transfer between the heat pipes 2 and the PCM 8. Since the diameter of the canister 20 in this case may be relatively large, longitudinal fins 32 may be used to enhance the heat transfer between the heat pipes 2 and the PCM 8. A number of such units mentioned above can be attached separately on the suit close to various strategic parts of the human body to be cooled. The said PCM unit arrangement will make the cooling suit design and heat pipe arrangement in the suit more flexible, and the gravity function for returning liquid condensate in the heat pipe 2 from the condenser section to the evaporator section will be more fully utilized.

What is claimed is:

1. A human body cooling suit said human body cooling suit includes a flexible heat pipe, said heat pipe having an evaporator section and a condenser section means to transfer heat from said evaporator section to said condenser section, said heat transfer means include placing said condenser section to a higher level than that of said evaporator section, means to adjust the operating temperature of said flexible heat pipe, said flexible heat pipe includes plastic smooth and corrugated tubes as the shell of said heat pipe, a phase-change material (PCM) module, means to facilitate heat exchange between said PCM module and said heat pipe condenser section, said means include disposal of said PCM module at a higher level than that of said heat pipe evaporator section, and arrangement of said heat pipe condenser section within said PCM module, and means to replace a thawed PCM in said PCM module with a frozen PCM, suit clothing materials, said clothing materials consisting of an outer cover and an inner lining, said outer cover is made of thermal insulating materials, means to shield off the heat from the environment to the human body, said outer cover and inner lining sandwich said heat pipe evaporator section, means to facilitate heat exchange between said inner lining and said heat pipe evaporator section, said means include air circulation in the space formed by said outer cover, said inner lining, and said heat pipe evaporator section wherein said PCM module is comprised of a container having a sleeve arranged within said container and said heat pipe condenser is arranged within said sleeve; thereby defining means to secure good thermal contact between said sleeve and said heat pipe condenser; means for easy removal of said heat pipe condenser from said sleeve; and means to adjust the thermal resistance between said sleeve and said heat pipe condenser.

2. The invention as described in claim 1 wherein said PCM module is further comprised of at least a rib which connects said container and said sleeve, an amount of PCM, said PCM is disposed inbetween said container, said sleeve, and said rib, thereby establishing means to enhance heat transfer between said heat pipe condenser and said PCM, and wherein insulation covers the outer surface of said container and is removable from said container.

3. The invention as described in claim 1 wherein said PCM module is comprised of a canister filled with PCM and means to enhance heat transfer within said PCM module including fins disposed inside said canister and a large sleeve housing said canister, thereby defining means to secure good thermal contact between said large sleeve and said canister, means to facilitate easy removal of said canister from said large sleeve, and means to adjust the thermal resistance between said large sleeve and said canister; wherein said heat pipe condenser is disposed on the exterior circumferential surface of said large sleeve; said PCM module container is provided with a heat transfer medium disposed between an inner surface of said container and said heat pipe condenser defining means to enhance heat transfer between said large sleeve and said heat pipe condenser; and wherein said container is covered with a layer of removable insulation.

* * * * *